United States Patent [19]

Faunce

[11] 3,935,004

[45] Jan. 27, 1976

[54] ADDITION OF ALLOYING CONSTITUENTS TO ALUMINUM

[75] Inventor: John Porter Faunce, Columbia, Md.

[73] Assignee: Diamond Shamrock Corporation, Cleveland, Ohio

[22] Filed: Nov. 11, 1974

[21] Appl. No.: 522,330

Related U.S. Application Data

[63] Continuation-in-part of Ser. No. 399,176, Sept. 20, 1973, abandoned.

[52] U.S. Cl. ..... 75/68 R; 29/192 R; 75/.5 R; 75/138

[51] Int. Cl.[2] ..... C22C 1/02

[58] Field of Search ..... 75/68 R, 135, 138, 44 R, 75/134 M; 29/192

[56] References Cited

UNITED STATES PATENTS

| | | | |
|---|---|---|---|
| 2,911,297 | 11/1959 | Florenz | 75/135 |
| 2,935,397 | 5/1960 | Saunders | 75/44 R X |
| 3,591,369 | 7/1971 | Tuthill | 75/138 |
| 3,592,637 | 7/1971 | Brown | 75/138 |
| 3,788,839 | 1/1974 | Faunce | 75/93 R |
| 3,793,007 | 2/1974 | Kline | 75/134 M |

FOREIGN PATENTS OR APPLICATIONS

| | | | |
|---|---|---|---|
| 2,304,757 | 8/1973 | Germany | 75/138 |

*Primary Examiner*—L. Dewayne Rutledge
*Assistant Examiner*—Arthur J. Steiner
*Attorney, Agent, or Firm*—William A. Skinner

[57] ABSTRACT

Metals are alloyed into aluminum using a solid compact comprised of particles containing a high concentration of the metal to be added. The compacts are prepared by blending finely divided particles of the metal containing material with a salt fluxing agent, then compacting the mixture into a readily useable form such as a pellet. The resultant pellet provides rapid dissolution of the alloying constituent in the aluminum whether cold charged to the furnace or added to a molten bath over a wide range of bath temperatures.

19 Claims, No Drawings

ADDITION OF ALLOYING CONSTITUENTS TO ALUMINUM

CROSS-REFERENCE TO RELATED APPLICATION

This application is a continuation-in-part of copending application Ser. No. 399,176 filed Sept. 20, 1973 now abandoned.

FIELD OF THE INVENTION

This invention relates to a process and composition for the addition of metal alloying constituents to aluminum. More particularly, the present invention is directed to a method for incorporating alloying constituents such as manganese, chromium, and iron into aluminum. The alloying constituents in the form of a compacted mixture of particulate metal and a non-hygroscopic chemical fluxing agent are either introduced directly into a molten aluminum bath or are charged into an essentially empty furnace with raw aluminum prior to melt-down and then heated. The process and composition of the invention afford rapid, complete solution of the alloying constituents in aluminum at temperatures as low as 1,280°F. (693°C.).

BACKGROUND OF THE INVENTION

There are several methods disclosed in the literature for alloying high melting temperature metals such as manganese, chromium, and iron into aluminum. One method, disclosed in U.S. Pat. No. 2,911,297, involves the preparation of a briquette of powdered alloying metal and a dispersing agent. When such a briquette is introduced into a metal melt, the dispersing agent gives off a reactive gas or vapor, spontaneously disrupting the briquette and dispersing the powdered metal into the melt. This method has several disadvantages, including the undesirable "boiling up" effect on the molten bath caused by the evolution of gas from the dispersing agent which may result in undissolved powdered metal being floated to the top of the bath. Additionally, it is necessary to include a large amount (usually more than ten percent) of dispersing agent in the briquette.

A more recent method involves pre-mixing finely divided manganese containing particles with finely divided aluminum particles and compacting the mixture into a pellet or briquette. Brown et al. (U.S. Pat. No. 3,592,637) disclose that a briquette or compact comprised of a blended mixture of at least two different finely divided metal bearing materials rapidly dissolves when the briquette contains a "promoter material" such as finely divided aluminum. When such a compacted mixture is added to a bath of molten aluminum the lower melting portion of the mixture (i.e. the finely divided aluminum) melts and thus assists in the dispersion of the remaining mass of manganese. The speed at which the manganese then dissolves in the molten bath is merely a function of particle size, surface area, and bath variables such as temperature and amount of stirring.

Although offering improvements over previous methods, the practice described by Brown et al. also has several disadvantages. The finely divided aluminum needed to produce the briquette is expensive to purchase or produce. In actual practice, the composition of the briquette produced generally contains a significant proportion of aluminum, thus resulting in large quantities of briquettes being required to achieve the desired manganese content in the final alloy. Additionally, the alloying process described in U.S. Pat. No. 3,592,637 was carried out at bath temperatures of about 1400°F. (760+C.) or higher. In actual practice, the temperature of the molten bath to which such a briquette is added is critical with respect to the rate at which the briquette will dissolve. At bath temperatures of about 1,280°F. (693°C.) to about 1,375°F. (746°C.), typical operating temperatures for aluminum baths in commercial operations, the solubility rate of such a briquette is markedly reduced. Thus this method suffers from the further disadvantage of requiring higher than normal operating bath temperatures to successfully incorporate a metal briquette into the bath.

Another recent method is described in U.S. Pat. No. 3,591,369. This patent discloses that manganese metal added to molten aluminum in the form of a manganese body having thereon a coating containing a complex potassium fluoride compound dissolves at a more rapid rate than a similar body of manganese without the coating. Theoretically the coating enhances the wetting of the manganese surface by the molten aluminum. This method is also desirable due to the costly process and controls required to produce coated manganese containing metal. In actual practice, this type of additive rarely yields recoveries above 90% and often takes in excess of one hour to achieve this value. Such incomplete recovery can result in a "build-up" of manganese in the furnace or vessel in which the alloy is being produced, causing serious metallurgical problems. In addition, this product requires bath temperatures of about 1375°–1400°F. (746°–760°C.) to obtain maximum solubility of the manganese in aluminum.

U.S. Pat. No. 3,793,007 describes a method for the addition of manganese particles having a specified size range (predominantly larger than 0.15 mm., or 100 mesh) to molten aluminum. The manganese is added in admixture with 3–10% of a fluxing agent which forms a molten phase at the temperature of the aluminum bath. The patent indicates that the alloying composition requires a substantial amount of fluxing agent as the particle size of the manganese is reduced, i.e. as the particle size range decreases toward 0.15 mm. the amount of flux required increases toward the 10% level. Some form of protective packaging to prevent undesirable absorption of moisture from the atmosphere by the fluxing agent prior to addition to the aluminum bath is also recommended.

Simply making a compact from finely divided manganese or other alloying constituents for addition to a molten aluminum bath is not a satisfactory solution. It has been found that if particulate alloying metal is to alloy into molten aluminum it is first necessary for the aluminum to contact and surround the particles. In the absence of some fluxing agent or "promoter materials", air remains trapped within the voids between the particles and prevents aluminum from pentrating such a compact, consequently preventing the required contact for complete solution. Nor is adding the finely divided alloying material to the molten bath in a unbriquetted or bulk form a practical solution. In bulk form, the fine particles tend to become trapped in the oxide or dross layer that exists in commercial practice on the surface of molten aluminum baths. The finer the particles, the more pronounced this problem becomes. This results in highly variable and usually poor recovery of alloying constituent in the final alloy.

Additionally, it has been a requirement of the newer types of alloying additives and processes for use in aluminum that the additive be introduced directly into a molten aluminum bath, rather than charged to an essentially empty furnace at the same time the other ingredients are added and then brought to a molten state. Frequently alloying constituents having a large particle size (i.e. greater than 0.15 mm. or 100 mesh) are used in order to avoid the aforementioned solubility problems as well as undue losses due to the more rapid oxidation of extremely fine material. When such relatively large particles, whether loose or in compacted form, are placed in a cold furnace with raw aluminum and heated, the first aluminum to become molten will surround the particles or penetrate into the compact. As this occurs, alloys of aluminum will be formed sooner than desired. These alloys have melting points much higher than the final operating temperature of the molten bath. The high melting aluminum alloys, containing significant amounts of manganese, chromium, or other alloying constituent, will then be lost from the final alloy. The composition of the final alloy is thus quite unpredictable.

The current practices for addition of alloying additives to aluminum thus require that all of the materials charged to the furnace must be heated to form a molten bath before any additive or hardener can be added. In order to simplify heat make-up operations, conserve fuel used in preparing the melt, and speed production of the alloy, it would be desirable to have an alloying additive or hardener which could be added to the other materials when charged to the melting furnace. This is known as "cold charging", or the addition of solid aluminum to an essentially empty melting furnace prior to actual melting. The most desirable additive is one which can be both cold charged and/or added to a molten bath. This permits maximum flexibility in alloy production.

Because of the disadvantages of the current state of the art, it remains desirable to provide an alloying additive and process for incorporating metals such as manganese, chromium, and iron into aluminum which will: (1) contain substantially only manganese, chromium, or iron so that smaller quantities are required for alloying; (2) be capable of dissolving in a molten bath of aluminum in short periods of time with high recoveries of the alloying constituents in the final alloy cold charged or added to a molten bath; (3) be adaptable to the technique of charging to an essentially empty furnace prior to melt-down of the charge ingredients; (4) not be limited in use to bath temperatures of 1,375°F. (745°C) or higher; (5) utilizes very fine particle size alloying constituents; and (6) not require the use of protective packaging or special handling procedures during storage and shipping.

SUMMARY OF THE INVENTION

A composition and method have been developed for the addition of alloying constituents such as manganese, chromium, and iron to aluminum. Metal alloying material having a particle size less than about 0.25 mm. is blended with from about 0.1 to about 2.5 percent of a non-hygroscopic salt fluxing agent and if necessary a small amount of a binder material. The resulting mixture is then compacted into a coherent body.

The compacts of the present invention have numerous advantages, including the ability to dissolve rapidly and completely in aluminum whether cold charged or added directly to molten baths. The composition and process give high metal recoveries in the resulting alloy over a wide range of operating aluminum bath temperatures, even when the compacts are cold charged.

The composition and process also utilizes extremely finely divided particles of alloying metals, which heretofore had not been considered useful due to their tendency to become trapped in the dross layer and to give erratic recoveries.

A further advantage of this invention is the provision of additives which do not contain significant amounts of material extraneous to the alloying constituents which would dilute the metal value. An additional economy is realized by the user in that no specialized equipment or packaging procedures are necessary to utilize the additive. Compacts of the invention are easily handled and are stable during transportation and storage without the need for special precautions.

DESCRIPTION OF THE PREFERRED EMBODIMENTS

A composition has been discovered for the addition of alloying metals to aluminum, which composition comprises from 97.5 to 99.9 percent by weight of a particulate metal alloying material selected from the group consisting of manganese, chromium, and iron, wherein substantially all of the metal has a particle size less than about 0.25 mm., blended with 0.1 to 2.5 percent by weight of a non-hygroscopic salt fluxing agent. The composition is compacted into a coherent body, which is then admixed with the aluminum to be alloyed either by cold charging into the melting furnace or by adding directly to molten aluminum.

The alloying additive generally is prepared by mixing an appropriate fluxing agent in the form of a dry salt with particulate alloying material of predominantly less than about 0.25 mm. (60 mesh) in size, and preferably predominantly less than about 0.15 mm. (100 mesh). The alloying material will usually contain a substantial proportion of particles smaller than 0.075 mm. (200 mesh) and ranging in size to under 0.044 mm. (325 mesh). The alloying material is reduced to powder form by conventional grinding techniques.

In the general practice of the invention manganese, chromium, or iron selected from a suitable source is crushed such that substantially all of the particles are less than 0.25 mm. (60 mesh) in size. This material will have a particle size distribution similar to that shown in Table I for typical manganese particles.

TABLE I

| mm. (Mesh) | % Retained |
|---|---|
| 0.250 (60) | < 0.1 |
| 0.210 (70) | 1.1 |
| 0.177 (80) | 26.2 |
| 0.149 (100) | 9.8 |
| 0.105 (140) | 27.2 |
| 0.088 (170) | 5.0 |
| 0.074 (200) | 6.5 |
| 0.053 (270) | 8.9 |
| 0.044 (325) | 4.8 |
| < 0.044 (325) | 10.8 |

However in carrying the invention into practice, a particle size distribution similar to that shown for manganese in Table II is particularly desirable.

TABLE II

| mm. (Mesh) | % Retained |
|---|---|
| 0.250 (60) | 0.6 |

TABLE II-continued

| mm. (Mesh) | % Retained |
|---|---|
| 0.177 (80) | 6.6 |
| 0.149 (100) | 3.5 |
| 0.105 (140) | 13.4 |
| 0.088 (170) | 6.9 |
| 0.074 (200) | 7.5 |
| 0.063 (230) | 4.0 |
| 0.053 (270) | 11.1 |
| 0.044 (325) | 7.3 |
| < 0.044 (325) | 38.9 |

It should be noted that both these embodiments utilize material having a substantial portion less than 0.15 mm. (100 mesh) in size, of which the material less than 0.044 mm. (325 mesh) is an appreciable portion, generally at least 30 percent of the total material in the preferred embodiment.

The source of manganese alloying material can be any manganese-containing material such as manganese, ferromanganese, electrolytic manganese, or impure manganese. The source of chromium alloying material can be electrolytic chromium, ferrochromium, chromium, or impure chromium. The source of iron alloying material can be electrolytic iron, impure iron, or an alloy containing more than 50 percent by weight iron.

The chemical fluxing agent is generally a compound which has an eutectic melting point at least 50°F. (28°C.) below the operating temperature of the bath to which the alloying additive will be added if it is added to a molten bath, and in all cases will have a melting point below 1,450°F. (788°C.). The fluxing agent may undergo physical changes at temperatures below the liquidus temperature of aluminum or aluminum alloys, but remains inert and dormant as a flux at such temperatures. The amount of fluxing agent used in the composition may range from about 0.10 to about 2.5 percent, but preferably is from about 0.5 to about 1.5 percent by weight of the total mixture. The agent, when present in the mixture in the proper quantity, is believed to react with any manganese, chromium, iron, and aluminum oxides present to produce a fluxing action at temperatures above the liquidus temperature of aluminum or commercial aluminum alloys. Such action aids in wetting of the metals and increases the rate of dissolution of the alloying constituent into the aluminum.

Chemical fluxing agents which are useful in the preparation of pellets, or compacts, for the alloying process of this invention include a wide range of materials, including the metal halide salts, salts produced by the reaction of hydrofluosilicic acid with salts of sodium, barium, potassium and other elements, as well as the commercially available compound $KBF_4$. Particularly preferred fluxing agents include $KBF_4$ and also the combination of salts having the approximate stoichiometric ratio represented by the empirical formula $K_5Na_3Ba_2(SiF_6)_6$. The preferred salt fluxing agents are those which are non-hygroscopic, a characteristic which is critical in practical operation of the process. If the fluxing agent used in preparing the pellets absorbs significant quantities of water, there is the danger of a violent reaction when the pellets contact molten aluminum. There is also a problem of absorbed water reacting with the metal alloying constituents of the compact during storage, resulting in the formation of oxides. This reaction, once begun, will cause the compacted mixture to disintegrate, often quite rapidly. Thus many salts which have the characteristics of melting at the desired temperature and reacting with oxides to produce a fluxing action require special handling due to their tendency to absorb water. Compounds such as $MnCl_2$, KF, mixtures of K, Ba, and Na chlorides and others are not useable due to their hygroscopic nature, as can be seen from the observations summarized in Table III:

TABLE III

| Salt | % Salt in Compact | Days | Condition |
|---|---|---|---|
| KF | 1.0 | 1 | Very wet |
| $MnCl_2$ | 0.75 | 2 | Decomposed |
| NaCl (75 mol %) | | | |
| $MnCl_2$ (25 mol %) | 1.25 | 2 | Decomposed |
| NaF (25 wt.%) | | | |
| NaCl (40 wt.%) | | | Saturated with |
| KCl (35 wt.%) | 1.0 | 3 | Moisture |
| NaCl (35 mol %) | | | |
| KCl (40 mol %) | | | |
| $BaCl_2$ (25 mol %) | 1.25 | 4 | Decomposed |
| LiCl | 1.0 | 6 | Partially decomposed |
| KCl | 1.0 | 10 | Partially decomposed |
| KCl (40 wt. %) | | | |
| NaCl (40 wt. %) | | | |
| $Na_3AlF_6$ (20 wt.%) | 1.0 | 10 | Decomposed |
| $KBF_4$ | 1.0 | 180 | No change |
| $K_5Na_3Ba_2(SiF_6)_6$ | 0.75 | 180 | No change |

The compacts set forth in Table III were prepared using manganese particles having a particle size of less than 0.25 mm. (60 mesh), blending with the designated amounts of salt or salt mixtures, and compacting into coherent pellets. The pellets were then allowed to stand in the open room atmosphere and were observed periodically. Non-hygroscopic fluxes suitable for use in the composition and process of the invention will remain dry and form compacts which are stable for an indefinite period. Unsuitable materials will visibly take up water and cause disintegration of the compact. It is conceivable that by the use of complicated production and packaging methods a hygroscopic fluxing agent could be used, but this is not an economical solution. Use of the preferred salt fluxing agents overcomes the problem entirely.

Production aluminum melting furnaces usually are operated such that the ingredients required (mill scrap, pure aluminum, etc.) are charged into an essentially empty furnace, heated until a molten bath is formed, and the molten bath stirred. Alloy additives have generally been added after melt-down of the initial charge. In order for an alloy additive to be successfully added with the initial charge to an essentially empty furnace (cold charged), the additive should remain inactive below the liquids temperature of the aluminum, i.e. the additive should be dormant until all the other ingredients in the furnace have formed a molten bath. The molten bath is normally maintained at a temperature of about 1,325°F. (718°C.) to about 1,375°F. (746°C.), but may operate from about 1280°F. (693°C.) to about 1500°F. (815°C.). It is therefore important that the pellets heretofore described be capable of effecting rapid dissolution and high metal recovery over a broad temperature range and a variety of operating conditions. All of the preferred fluxing agents, when present in the pellets in the proper amount, permit the alloying additive of the invention to be used at bath temperatures within the range of about 1280°F. (693°C.) to about 1500°F. (815°C.), and also enable the additive to be cold charged into the furnace without affecting the solubility rate or the metal recovery.

The ability of the present composition and process to operate effectively at bath temperatures as low as 1280°F. (693°C.) affords considerable savings in energy requirements necessary to bring the aluminum bath to a molten state, and to maintain it. The use of low bath temperatures also minimizes the undesirable absorption of hydrogen into the molten aluminum, a phenomenon which occurs at higher bath temperatures. The ability of the present process to be used either with cold charging or direct addition to a molten bath also affords a degree of flexibility not heretofore available and simplifies heat make-up.

To improve the green strength of the pellets and to facilitate pelletizing, a small amount of a binder may also be blended into the metal/flux mixture. The amount of binder incorporated into the mixture may vary depending upon parameters such as the size of the alloying metal particles, the nature of the alloying metal, the type of compacting apparatus used, and the desired density of the finished compact. When used, the proportion of binder need only be such that a stable, coherent body results upon compacting of the mixture. One binder found to be generally satisfactory is a 5–15 percent solution of sodium silicate, used in the proportions of about 10 cc. of binder solution per 100 grams of manganese particles and about 15 cc. of solution per 100 grams of chromium and iron particles. Other binders such as molasses, methyl cellulose, or hydroxy-alkyl methyl cellulose derivatives may be used, but products containing organic materials are not desirable due to the formation of combustion products upon contact with the molten aluminum which may cause objectionable fumes.

The mixture is then compacted using conventional equipment. The preferred type of compact, the pellet, may be prepared using equipment such as the three foot diameter, variable speed pelletizing disc manufactured by Ferro-Tech, Inc. Other types of compacts may be prepared using a conventional arbor press or briquetting equipment. When the pelletizing disc is used, the feed rate is controlled so that the bed in the disc is maintained at a uniform depth in order to produce spherical pellets of from about 0.6 cm. (one-fourth inch) to about 2 cm. (three-fourth inch) in diameter. The pellets thus formed may have from about 25% to about 45% of their volume as voids, but in all cases have a density appreciably greater than that of aluminum (i.e. greater than about 2.75 grams per cc.). When removed from the pelletizing disc the pellets may be dried in an oven at 248°F. (120°C.) for a period of time sufficient to remove any moisture present, particularly if a binder is used.

While normally only a single alloying metal is present in the additive, it may under certain circumstances be desirable to include two or all three of the metals in a single compact. Such a composition is within the intended scope of this invention.

The method of the invention will be further understood by reference to the following illustrative examples which should not be construed as limiting the invention. The term liquidus temperature as used herein refers to that temperature at which the composition of an alloy system completes melting upon heating or begins to solidify upon cooling. The terms mesh as used herein refers to a specified particle size determined by the use of U.S. Standard Sieve Series screens.

EXAMPLE 1

A blend of 0.5% by weight of commercially available $KBF_4$ and manganese fines less than 0.25 mm. in size containing 92.7% by weight manganese (the balance essentially iron and traces of other elements) was mixed with sodium silicate binder and pelletized into 0.6–2.0 cm. diameter pellets, then dried. The pellets were added to a molten bath of aluminum in sufficient quantity to yield an aluminum alloy containing 0.86% manganese. The temperature of the molten bath was 1505°F. (819°C.). The bath was stirred 6 minutes. A sample taken 30 minutes after the manganese was added was analyzed and showed a manganese recovery of 100%. The particle size distribution of the manganese fines used, as determined by sieve analysis, was:

| mm. (Mesh) | % Retained |
|---|---|
| 0.250 (60) | < 0.1 |
| 0.210 (70) | 1.1 |
| 0.177 (80) | 26.2 |
| 0.149 (100) | 9.8 |
| 0.105 (140) | 27.2 |
| 0.088 (170) | 5.0 |
| 0.074 (200) | 6.5 |
| 0.053 (270) | 8.9 |
| 0.044 (325) | 4.8 |
| < 0.044 (325) | 10.8 |

EXAMPLE 2

A salt fluxing agent was prepared by adding a warm solution of 126 grams $Ba(OH)_2.8H_2O$ in 400 ml. distilled water to 600 ml. of 25% $H_2SiF_6$ solution to precipitate $BaSiF_6$. A solution of 60 grams KOH and 26 grams NaOH in 200 ml. water was then added to the slurry and the resultant mixture was cooled to room temperature and filtered. The filter cake was lightly washed with water and was dried at 232°F.(110°C.) for one hour. The recovered salt was found to have a molar ratio of K:Na:Ba of 5:3:2, and an empirical formula of $K_5Na_3Ba_2(SiF_6)_6$. A blend of 0.75% by weight of this salt and manganese fines less than 0.6 mm. in size containing 93% by weight manganese (the balance iron and traces of other elements) was mixed with sodium silicate binder and compacted into the form of briquettes, then dried. The briquettes were added to a molten bath of aluminum at 1290°F. (699°C.) in sufficient quantity to yield an aluminum alloy containing 0.96% manganese. The bath was stirred for 3.5 minutes. A sample taken 30 minutes after the manganese had been added was analyzed and showed a manganese recovery of 97.5%.

EXAMPLE 3

A blend of 0.75% by weight $K_5Na_3Ba_2(SiF_6)_6$ prepared as described in Example 2 and manganese fines less than 0.21 mm. in size containing 93% by weight manganese (the balance essentially iron and traces of other elements) was mixed with sodium silicate binder and pelletized into 0.17–0.5 cm. pellets, then dried. The pellets were added to a molten bath of aluminum at 1310°F. (710°C.) in sufficient quantity to yield an aluminum alloy containing 1.02% manganese. The bath was stirred 3.5 minutes. A sample taken 30 minutes after the manganese had been added was analyzed and showed a manganese recovery of 100%. The particle size distribution of the manganese fines used, as determined by sieve analysis, was:

| mm. (Mesh) | % Retained |
|---|---|
| 0.210 (70) | 0 |
| 0.149 (100) | 20.3 |
| 0.105 (150) | 20.8 |
| 0.088 (170) | 9.9 |
| 0.074 (200) | 11.0 |
| 0.063 (250) | 5.9 |
| 0.053 (270) | 9.6 |
| 0.044 (325) | 7.6 |
| < 0.044 (325) | 15.9 |

EXAMPLE 4

A blend of 0.5% by weight of $KBF_4$ and manganese fines less than 0.25 mm. in size containing 92.7% by weight manganese (the balance essentially iron and traces of other elements) was mixed with sodium silicate binder and compacted into 0.6–2.0 cm. diameter pellets, then dried. The pellets were added to a bath of molten aluminum at 1287° (697°C.) in sufficient quantity to yield an aluminum alloy containing 0.45% manganese. The bath was stirred six minutes. A sample taken 30 minutes after the manganese had been added was analyzed and showed a manganese recovery of 95%.

EXAMPLE 5

A blend of 1% by weight $KBF_4$ and manganese fines less than 0.25 mm. in size containing 93% manganese by weight (the balance essentially iron plus traces of other elements) was mixed with sodium silicate binder and compacted into 0.3–0.5 cm. diameter pellets, then dried. The pellets were added to a bath of molten aluminum at 1295°F. (703°C.) in sufficient quantity to yield an aluminum alloy containing 1.02% manganese. The bath was stirred for 4 minutes. A sample taken 20 minutes after the manganese had been added was analyzed and showed a manganese recovery of 96%.

EXAMPLE 6

A blend of 1.0% by weight $KBF_4$ and electrolytic chromium fines less than 0.177 mm. in size containing 99.9% chromium was mixed with sodium silicate binder and pelletized into pellets of from about 0.6–2.0 cm. diameter, then dried. The pellets were added to a bath of molten aluminum at 1,390°F. (754°C.) in a quantity sufficient to yield an aluminum alloy containing 0.98% chromium. The bath was stirred 2.5 minutes. A sample taken 15 minutes after the chromium had been added was analyzed and showed a 95% chromium recovery. The particle size distribution of the electrolytic chromium fines used, as determined by sieve analysis, was:

| mm. (Mesh) | % Retained |
|---|---|
| 0.177 (80) | 0 |
| 0.149 (100) | 17.1 |
| 0.105 (140) | 46.4 |
| 0.088 (170) | 23.0 |
| 0.074 (200) | 9.0 |
| 0.063 (230) | 1.3 |
| < 0.063 (230) | 3.1 |

EXAMPLE 7

A blend of 0.3% by weight $KBF_4$ and electrolytic iron fines less than 0.15 mm. in size containing 99.8% iron was mixed with sodium silicate binder and compacted into pellets, then dried. The particle size distribution of the electrolytic iron, as determined by sieve analysis, was:

| mm. (Mesh) | % Retained |
|---|---|
| 0.149 (100) | 0.5 |
| 0.105 (140) | 20.2 |
| 0.088 (170) | 12.9 |
| 0.074 (200) | 15.2 |
| 0.063 (230) | 7.4 |
| 0.053 (270) | 9.8 |
| 0.044 (325) | 10.6 |
| < 0.044 (352) | 22.3 |

The pellets were added to a molten bath of aluminum at 1310°F. (710°C.) in sufficient quantity to yield an aluminum alloy containing 1.23% iron. The bath was stirred a total of 3 minutes. A sample taken 26 minutes after the iron had been added was analyzed and showed an iron recovery of 100%.

EXAMPLE 8

A blend of 1.0% by weight $KBF_4$ and manganese fines less than 0.25 mm. in size containing 92.7% by weight manganese (the balance essentially iron and trace elements) was mixed with sodium silicate binder and compacted into 1–2 cm. diameter pellets, then dried. The particle size distribution of the manganese, as determined by sieve analysis, was:

| mm. (Mesh) | % Retained |
|---|---|
| 0.250 (60) | 10.1 |
| 0.177 (80) | 8.1 |
| 0.149 (100) | 5.6 |
| 0.105 (140) | 10.3 |
| 0.088 (170) | 6.0 |
| 0.074 (200) | 7.2 |
| 0.063 (230) | 3.1 |
| 0.053 (270) | 12.6 |
| 0.044 (325) | 6.1 |
| < 0.044 (325) | 31.0 |

These pellets were added to an aluminum melting furnace by charging directly into an essentially empty furnace prior to adding the other charge components (cold charging). The quantity of pellets was sufficient to yield an aluminum alloy containing 0.80% manganese. It took 3 hr. and 20 min. for all the charge components to melt down and come to a temperature of 1,380°F. (740°C.) at which time the molten bath was stirred for 4 minutes and a sample taken for analysis. Analysis showed a manganese recovery of 100%.

Thus it is apparent that there has been provided, in accordance with the invention, a composition and process that fully satisfy the objects and advantages set forth above. While the invention has been described with particular reference to specific embodiments thereof, it is evident that many alternatives, modifications, and variations will be apparent to those skilled in the art in light of the foregoing description. Accordingly, it is intended to embrace all such alternatives, modifications, and variations as fall within the spirit and scope of the appended claims.

What is claimed is:

1. A compacted alloying addition for alloying metals to aluminum, which consists essentially of from about 97.5 to about 99.9 percent by weight of at least one particulate metal alloying material selected from the group consisting of manganese, chromium, and iron, substantially all of said metal having a particle size less than about 0.25 mm., and about 0.1 to 2.5 percent by weight of non-hygroscopic salt fluxing agent selected from the group consisting of $KBF_4$ and $K_5Na_3$ $Ba_2(SiF_6)_6$.

2. An additive according to claim 1 wherein substantially all of the metal alloying material has a particle size less than 0.15 mm. and contains at least about 30 percent material having a particle size less than 0.05 mm.

3. An additive according to claim 1 wherein the salt fluxing agent is inactive as a flux at temperatures below the liquidus temperature of aluminum.

4. An additive according to claim 1 wherein the salt fluxing agent has a melting point below 788°C.

5. An additive according to claim 1 wherein the amount of salt fluxing agent ranges from about 0.1 to about 1.5 percent by weight.

6. An additive according to claim 1 wherein a binder material is additionally present in an amount sufficient to obtain a coherent body upon compacting of the composition.

7. An additive according to claim 6 wherein the binder material is sodium silicate.

8. An additive according to claim 1 wherein the manganese alloying material is selected from the group consisting of high purity manganese, ferro-manganese, electrolytic manganese, and impure manganese.

9. An additive according to claim 1 wherein the chromium alloying material is selected from the group consisting of chromium, ferro-chromium, impure chromium, and electrolytic chromium.

10. An additive according to claim 1 wherein the iron alloying material is selected from the group consisting of electrolytic iron, impure iron, and alloys containing more than 50 percent iron by weight.

11. An additive according to claim 1 which contains manganese alloying material substantially all having a particle size less than 0.15 mm., from 0.1 to 1.5 percent by weight of $KBF_4$, and a binder material in an amount sufficient to obtain a coherent body upon compacting.

12. A process for the addition of metal alloying constituents to aluminum, which comprises;

blending a mixture of at least one particulate metal alloying material selected from manganese, chromium, and iron, substantially all of said metal having a particle size less than about 0.25 mm., with from about 0.1 to about 2.5 percent by weight of a non-hygroscopic salt fluxing agent selected from the group consisting of $KBF_4$ and $K_5$ $Na_3$ $Ba_2(SiF_6)_6$;

compacting the blended mixture into a coherent body; and admixing the compacted mixture with the aluminum to be alloyed.

13. The process of claim 12 wherein the compacted mixture is admixed by charging into an essentially empty furnace together with the aluminum prior to melt-down of the charge, and the further step of heating the aluminum above its liquidus temperature is carried out.

14. The process of claim 12 wherein the compacted mixture is admixed with molten aluminum.

15. The process of claim 12 wherein substantially all of the metal alloying material has a particle size less than 0.15 mm. and contains at least about 30 percent material having a particle size less than 0.05 mm.

16. The process of claim 12 wherein a binder material is additionally incorporated into the blended mixture prior to compacting, and the compacted mixture is dried prior to admixing with the aluminum.

17. The process of claim 12 wherein the salt fluxing agent is inactive as a flux at temperatures below the liquidus temperature of aluminum.

18. The process of claim 12 wherein the amount of salt fluxing agent ranges from about 0.1 to about 1.5 percent by weight.

19. The process of claim 12 wherein the mixture contains manganese metal alloying material substantially all having a particle size less than 0.15 mm., from 0.1 to 1.5 percent by weight of $KBF_4$, and a binder material is additionally present in an amount sufficient to obtain a coherent body upon compacting of the blended mixture.

* * * * *